US009712924B2

(12) United States Patent
Yoo et al.

(10) Patent No.: US 9,712,924 B2
(45) Date of Patent: Jul. 18, 2017

(54) MICROPHONE AND METHOD OF MANUFACTURING THE SAME

(71) Applicant: Hyundai Motor Company, Seoul (KR)

(72) Inventors: Ilseon Yoo, Seoul (KR); Hyunsoo Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 66 days.

(21) Appl. No.: 14/791,449

(22) Filed: Jul. 5, 2015

(65) Prior Publication Data

US 2016/0112785 A1 Apr. 21, 2016

(30) Foreign Application Priority Data

Oct. 17, 2014 (KR) ..... 10-2014-0141156

(51) Int. Cl.

| | |
|---|---|
| ***H04R 31/00*** | (2006.01) |
| ***H04R 19/00*** | (2006.01) |
| ***H04R 7/26*** | (2006.01) |
| ***H04R 7/04*** | (2006.01) |

(52) U.S. Cl.

CPC ..... *H04R 19/005* (2013.01); *H04R 7/26* (2013.01); *H04R 31/00* (2013.01); *H04R 7/04* (2013.01); *H04R 2231/003* (2013.01); *H04R 2410/03* (2013.01)

(58) Field of Classification Search

CPC ..... G01R 33/0286; H04R 19/005; H04R 2201/003; H04R 2209/024; B81B 7/008; B81B 3/0002; B81B 2201/0257; B81B 2203/0127; B81B 2203/0353; B81B 2203/06; B81C 1/00134; B81C 1/00158; B81C 1/00182; B81C 1/00198; B81C 1/00206

USPC ..... 381/174, 175, 395, 191, 423, 424; 181/164, 167, 165; 257/252, 254, 416, 257/419

See application file for complete search history.

(56) References Cited

U.S. PATENT DOCUMENTS

| | | | | |
|---|---|---|---|---|
| 8,582,795 | B2 | 11/2013 | Miles et al. | |
| 2008/0075308 | A1* | 3/2008 | Wei | H04R 19/005 381/175 |
| 2010/0284553 | A1* | 11/2010 | Conti | B81B 7/0061 381/174 |
| 2013/0108084 | A1 | 5/2013 | Zhang | |

(Continued)

FOREIGN PATENT DOCUMENTS

| | | | |
|---|---|---|---|
| JP | 4355273 | B2 | 10/2009 |
| JP | 2014-179685 | A | 9/2014 |

(Continued)

*Primary Examiner* — Jesse A Elbin

(74) *Attorney, Agent, or Firm* — Mintz Levin Cohn Ferris Glovsky and Popeo, P.C.; Peter F. Corless

(57) ABSTRACT

A microphone includes a substrate including a penetration hole; a vibration membrane disposed over the substrate and covering the penetration hole; a fixed electrode disposed over the vibration membrane and spaced apart from the vibration membrane; a fixed plate disposed over the fixed electrode; and a plurality of air inlets disposed in the fixed electrode and the fixed plate. The vibration membrane includes a plurality of slots positioned over the penetration hole, and an entire area of the plurality of slots is approximately 8% to approximately 19% of an entire area of the vibration membrane.

18 Claims, 17 Drawing Sheets

(56) References Cited

U.S. PATENT DOCUMENTS

| | | | | |
|---|---|---|---|---|
| 2015/0014787 | A1* | 1/2015 | Akiba | H01L 21/28008 257/392 |
| 2015/0230027 | A1* | 8/2015 | Inoue | H04R 19/00 381/191 |
| 2016/0021459 | A1* | 1/2016 | Inoue | B81B 7/0006 381/113 |

FOREIGN PATENT DOCUMENTS

| | | | |
|---|---|---|---|
| KR | 10-0716637 | B1 | 5/2007 |
| KR | 10-0957803 | B1 | 5/2010 |
| KR | 10-1126604 | B1 | 3/2012 |
| KR | 10-2012-0128538 | A | 11/2012 |

* cited by examiner

MICROPHONE AND METHOD OF MANUFACTURING THE SAME

CROSS-REFERENCE TO RELATED APPLICATION

This application claims priority to and the benefit of Korean Patent Application No. 10-2014-0141156 filed in the Korean Intellectual Property Office on Oct. 17, 2014, the entire contents of which are incorporated herein by reference.

BACKGROUND (a) Technical Field

The present disclosure relates generally to a microphone and a method of manufacturing the same, and more particularly, to a microphone having an improved sensitivity and a method of manufacturing the same.

(b) Description of the Related Art

Microphones can be utilized for a wide variety of uses, such as converting a voice into an electrical signal. Recently, microphones have been gradually downsized. To this end, the microectromechanical system (MEMS) technology has developed. A MEMS microphone is advantageous in that it is more resistant to humidity and heat compared to a conventional electret condenser microphone (ECM), and it may be downsized and integrated with a signal processing circuit.

In general, MEMS microphones are divided into two types: a capacitance-type and a piezoelectric-type.

The capacitance-type MEMS microphone includes a fixed electrode and a vibration membrane. When an external sound pressure is applied to the vibration membrane, a capacitance value is changed because the distance between the fixed electrode and the vibration membrane is changed. Sound pressure is measured based on an electrical signal generated at this time.

Meanwhile, the piezoelectric-type MEMS microphone includes only a vibration membrane. When the vibration membrane is deformed by external sound pressure, an electrical signal is generated due to a piezoelectric effect. Sound pressure is measured based on the electrical signal.

Currently, extensive research is being undertaken in order to improve the sensitivity of the capacitance-type MEMS microphone.

The above information disclosed in this Background section is only for enhancement of understanding of the background of the disclosure, and therefore, it may contain information that does not form the related art that is already known to a person of ordinary skill in the art.

SUMMARY OF THE DISCLOSURE

The present disclosure has been made in an effort to provide a microphone and a method of manufacturing the same, which have an advantage capable of improving sensitivity of a microphone.

Embodiments of the present disclosure provide a microphone, including: a substrate including a penetration hole; a vibration membrane disposed over the substrate and covering the penetration hole; a fixed electrode disposed over the vibration membrane and spaced apart from the vibration membrane; a fixed plate disposed over the fixed electrode; and a plurality of air inlets disposed in the fixed electrode and the fixed plate. The vibration membrane includes a plurality of slots positioned over the penetration hole, and an entire area of the plurality of slots is approximately 8% to approximately 19% of an entire area of the vibration membrane.

The vibration membrane may include a first part into which ions are injected and a second part positioned at a circumference of the first part.

The plurality of slots may be positioned outside of the first part.

The ions may include boron ions or phosphorous ions.

The fixed electrode may include a plurality of openings.

The fixed plate may include a plurality of first protrusions protruding in a direction from the fixed plate toward the vibration membrane protrude, and the plurality of first protrusions may penetrate the respective openings.

The fixed electrode may include a plurality of second protrusions protruding in a direction from the fixed electrode toward the vibration membrane.

The vibration membrane may be made of polysilicon or conductive materials.

The fixed electrode may be made of polysilicon or a metal.

The fixed plate may include a silicon nitride film.

The substrate may be made of silicon.

The microphone may further include a support layer disposed at the edge of the vibration membrane and configured to support the fixed electrode.

Furthermore, according to embodiments of the present disclosure, a method of manufacturing a microphone, includes: providing a substrate; forming a vibration membrane including a plurality of slots over the substrate; forming a sacrificial layer over the vibration membrane; forming a fixed electrode over the sacrificial layer; forming a fixed plate over the fixed electrode; forming a plurality of air inlets in the fixed electrode and the fixed plate; forming an air layer between the fixed electrode and the vibration membrane by removing part of the sacrificial layer; and forming a penetration hole in the substrate, through which a part of the vibration membrane is exposed, by etching a rear of the substrate. An entire area of the slots is approximately 8% to approximately 19% of an entire area of the vibration membrane.

The plurality of slots may be positioned over the penetration hole.

The forming of the vibration membrane may include: forming a buffer layer, through which a central part of the vibration membrane is exposed, over the vibration membrane; injecting ions into the exposed part of the vibration membrane using the buffer layer as a mask; and removing the buffer layer.

The ions may include boron ions or phosphorous ions.

The forming of the fixed electrode may include forming a plurality of openings and a plurality of depression units of the sacrificial layer in the fixed electrode. The boundary lines of the respective openings may be substantially identical to the boundary lines of the respective depression units.

The fixed plate may include a plurality of first protrusions configured to penetrate the respective openings and formed in the respective depression units.

The forming of the sacrificial layer may include forming a plurality of depression units by etching part of the sacrificial layer.

The fixed electrode may include a plurality of second protrusions which are positioned in the respective depression units.

As described above, and in accordance with an exemplary embodiment of the present disclosure, the slots having an area of 8% to 19% of the entire area of the vibration membrane are formed in the vibration membrane. Consequently, when the vibration membrane is vibrated (e.g., in response to an external sound), sensitivity of the microphone can be improved because an influence attributable to air damping is reduced. Furthermore, a detection area can be improved because the vibration membrane has increased stiffness by injecting ions into part of the vibration membrane.

DETAILED DESCRIPTION OF THE EMBODIMENTS

Figure 1:
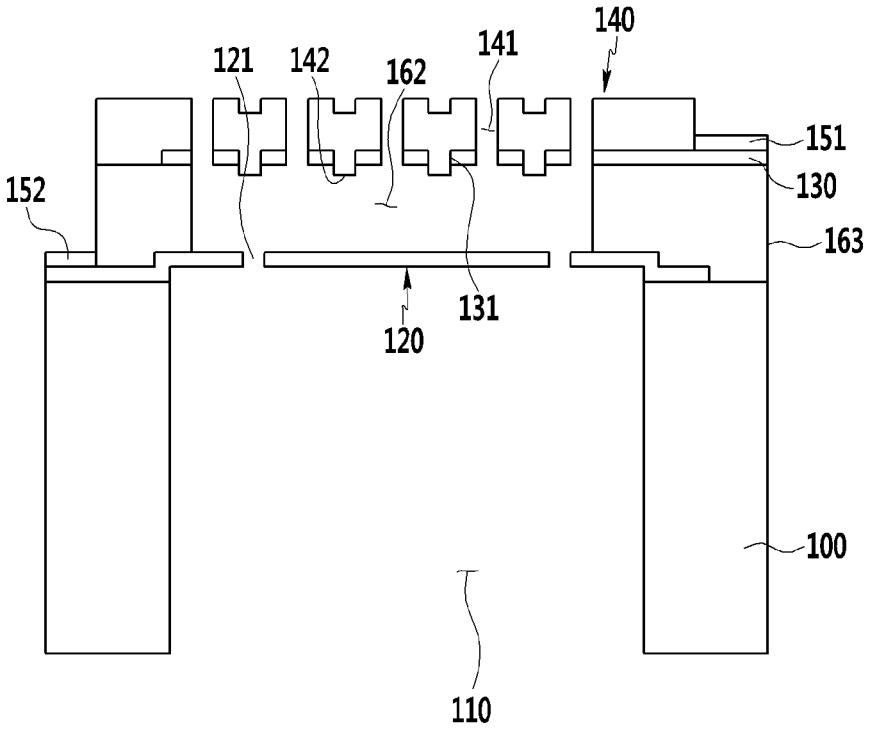
FIG. 1 is a schematic cross-sectional view of a microphone in accordance with embodiments of the present disclosure.

Hereinafter, embodiments of the present disclosure are described in detail with reference to the accompanying drawing. However, the present disclosure is not limited to the embodiments described herein, but may be materialized in other forms. On the contrary, the disclosed embodiments are provided to make the subject matter herein thorough and complete and to sufficiently describe the spirit of the present disclosure to those skilled in the art.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

In the drawings, the thickness of layers and areas has been enlarged for clarity of a description. Furthermore, when it is said that a layer is "on" another layer or a substrate, the layer may be directly formed on another layer or the substrate or a third layer may be interposed therebetween.

Hereinafter, a microphone in accordance with embodiments of the present disclosure is described with reference to FIGS. 1 and 2.

Figure 2:
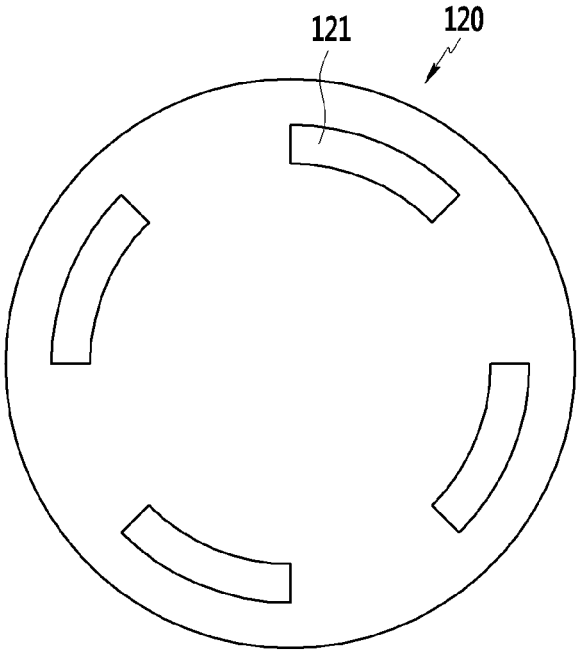
FIG. 2 is a top plan view schematically illustrating the vibration membrane of the microphone of FIG. 1.

FIG. 1 is a schematic cross-sectional view of a microphone in accordance with embodiments of the present disclosure, and FIG. 2 is a top plan view schematically illustrating the vibration membrane of the microphone of FIG. 1.

Referring to FIGS. 1 and 2, the microphone includes a substrate 100, a vibration membrane 120, a fixed electrode 130, and a fixed plate 140.

The substrate 100 may be made of silicon, and a penetration hole 110 is formed in the substrate 100. The vibration membrane 120 is disposed on the substrate 100. The vibration membrane 120 covers the penetration hole 110. Part of the vibration membrane 120 is exposed to the penetration hole 110, and part of the vibration membrane 120 exposed to the penetration hole 110 is vibrated in response to an external sound.

The vibration membrane 120 has a circular shape and includes a plurality of slots 121. The slots 121 are formed over the penetration hole 110. The vibration membrane 120 is illustrated as having 4 slots 121, but the present disclosure is not limited thereto. The number of slots 121 may be greater than 4. The slots 121 may have the same size or different sizes. The entire area of the slots 121 may be 8% to 19% of the entire area of the vibration membrane 120. The vibration membrane 120 may be made of polysilicon. However, the materials of the vibration membrane 120 are not limited to polysilicon. For example, the vibration membrane 120 may be made of conductive materials.

The fixed electrode 130 spaced apart from the vibration membrane 120 is disposed on the vibration membrane 120, and the fixed plate 140 is disposed on the fixed electrode 130. A plurality of air inlets 141 are disposed in the fixed electrode 130 and the fixed plate 140. The fixed electrode 130 is disposed on a support layer 163 and fixed thereto. The support layer 163 is disposed at an edge part of the vibration membrane 120, and it supports the fixed electrode 130. In this case, the fixed electrode 130 may be made of polysilicon or a metal. Furthermore, the fixed electrode 130 includes a plurality of support layers 131.

An air layer 162 is formed between the fixed electrode 130 and the vibration membrane 120. The fixed electrode 130 and the vibration membrane 120 are spaced apart from each other by a predetermined interval.

The fixed plate 140 comes in contact with the fixed electrode 130. The fixed plate 140 may be made of a silicon nitride. However, the materials of the fixed plate 140 are not limited to a silicon nitride, and the fixed plate 140 may be made of other insulating materials. Furthermore, the fixed plate 140 includes a plurality of first protrusions 142. The first protrusions 142 are configured to penetrate the respective openings 131 of the fixed electrode 130 and are protruded in the direction of the vibration membrane 120. In this case, the first protrusion 142 functions to prevent the vibration membrane 120 and the fixed electrode 130 from coming in contact with each other when the vibration membrane 120 is vibrated.

An external sound is introduced through the air inlets 141 formed in the fixed electrode 130 and the fixed plate 140, thus stimulating the vibration membrane 120. In response thereto, the vibration membrane 120 is vibrated. When the vibration membrane 120 is vibrated in response to the external sound, the distance between the vibration membrane 120 and the fixed electrode 130 is changed. Accordingly, capacitance between the vibration membrane 120 and the fixed electrode 130 is changed. A signal processing circuit (not shown) converts the changed capacitance into an electrical signal through a first pad 151 connected to the fixed electrode 130 and a second pad 152 connected to the vibration membrane 120, thereby being capable of detecting the external sound.

The vibration membrane 120 includes the plurality of slots 121. When the vibration membrane 120 is vibrated in response to an external sound, the slots 121 reduce an influence attributable to air damping, thereby improving the sensitivity of the microphone. In this case, air damping means that the vibration of the vibration membrane is reduced by air. As described above, the entire area of the slots 121 may be approximately 8% to approximately 19% of the entire area of the vibration membrane 120. If the entire area of the slots 121 is less than approximately 8% of the entire area of the vibration membrane 120, an effect in that a valid detection area is increased is reduced because the rigidity of the vibration membrane 120 is increased. Accordingly, it is difficult to improve sensitivity, and an effect in which an influence attributable to air damping is educed is also reduced. If the entire area of the slots 121 exceeds approximately 19% of the entire area of the vibration membrane 120, a noise signal is increased because the rigidity of the vibration membrane 120 is reduced, and a signal-to-noise ratio has a low value because a detection area is reduced.

The sensitivity characteristics of the microphone in accordance with embodiments of the present disclosure and a conventional microphone are described below with reference to FIGS. 3 and 4.

Figure 3:
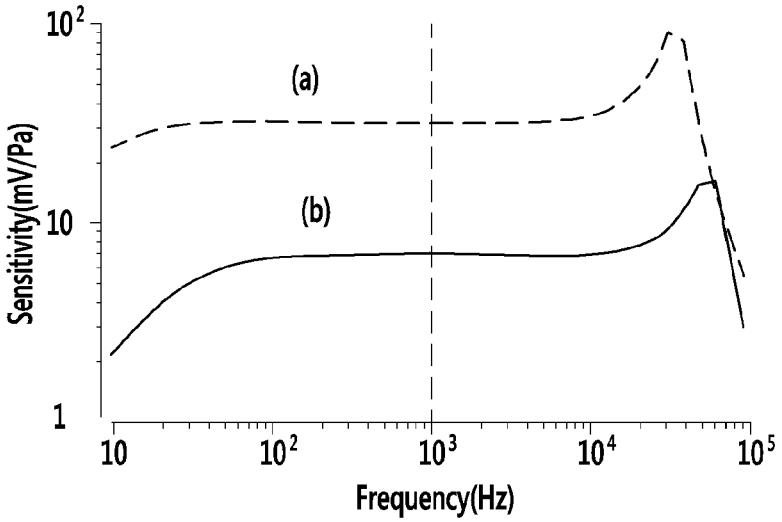
FIG. 3 is a graph illustrating sensitivities of the microphone in accordance with embodiments of the present disclosure and a conventional microphone.
Figure 4:
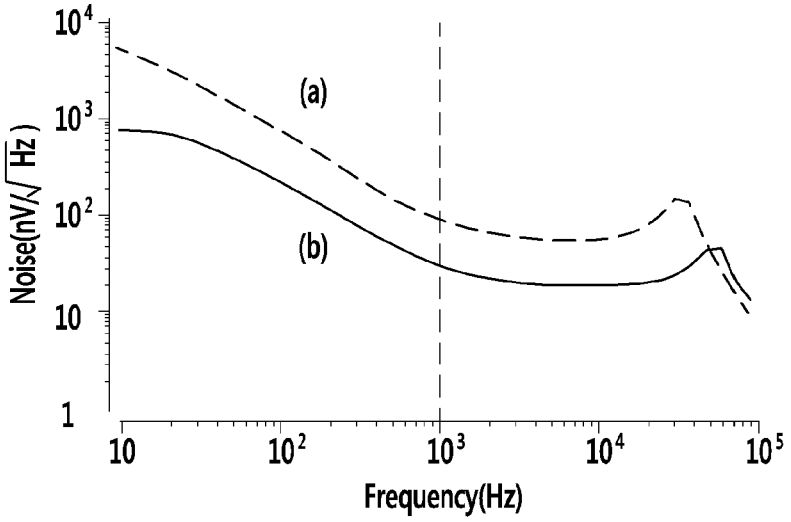
FIG. 4 is a graph illustrating noise of the microphone in accordance with embodiments of the present disclosure and a conventional microphone.

FIG. 3 is a graph illustrating sensitivities of the microphone in accordance with embodiments of the present disclosure and a conventional microphone, and FIG. 4 is a graph illustrating noise of the microphone in accordance with embodiments of the present disclosure and a conventional microphone.

In FIGS. 3 and 4, the vibration membrane of the microphone has a circular shape and includes four slots, and the entire area of the fours slots is approximately 12% of the entire area of the vibration membrane. The vibration membrane of the conventional microphone has a circular shape and does not include a slot. In this case, the vibration membrane of the microphone according to the presently disclosed embodiments and the vibration membrane of the conventional microphone are made of polysilicon.

FIG. 3 illustrates that the microphone according to embodiments of the present disclosure has sensitivity (mV/Pa) of 31.9 at 1 KHz and the conventional microphone has sensitivity (mV/Pa) of 6.8 at 1 KHz. That is, it may be seen that the sensitivity of the microphone disclosed herein is about 4.7 times that of the conventional microphone.

FIG. 4 illustrates that the microphone according to the presently disclosed embodiments has noise (nV/√Hz) of 89.4 at 1 KHz and the conventional microphone has noise (nV/√Hz) of 27.7 at 1 KHz. In the case of a signal-to-noise ratio (dB), the microphone has a ratio of 71.0, and the conventional microphone has a ratio of 67.8. As a result, it may be seen that the microphone disclosed herein has an improved signal-to-noise ratio.

A method of manufacturing the microphone in accordance with embodiments of the present disclosure is described below with reference to FIGS. 5 to 8.

FIGS. 5 to 8 are diagrams illustrating a method of manufacturing the microphone in accordance with embodiments of the present disclosure.

Figure 5:
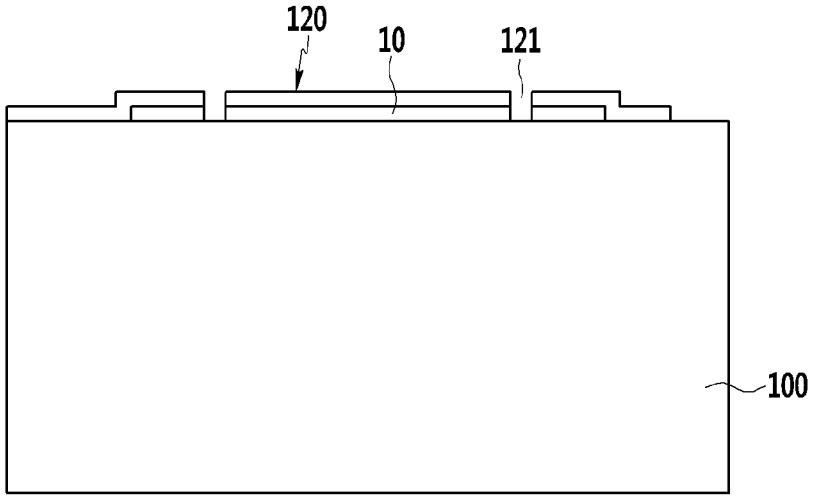
FIGS. 5 to 8 are diagrams illustrating a method of manufacturing the microphone in accordance with embodiments of the present disclosure.

Referring to FIG. 5, after the substrate 100 is prepared, an oxide layer 10 is formed on the substrate 100. The vibration membrane 120 including the plurality of slots 121 is formed on the oxide layer 10. In this case, the substrate 100 may be made of silicon, and the vibration membrane 120 may be made of polysilicon or conductive materials.

The vibration membrane 120 including the plurality of slots 121 may be formed by forming a polysilicon layer or a conductive material layer on the oxide layer 10 and patterning the polysilicon layer or the conductive material layer. In this case, the patterning of the polysilicon layer or the conductive material layer may be performed by forming a photoresist layer on the polysilicon layer or conductive material layer, forming a photoresist layer pattern by performing exposure and development on the photoresist layer, and etching the polysilicon layer or conductive material layer using the photoresist layer pattern as a mask. Likewise, the oxide layer 10 is also patterned.

Figure 6:
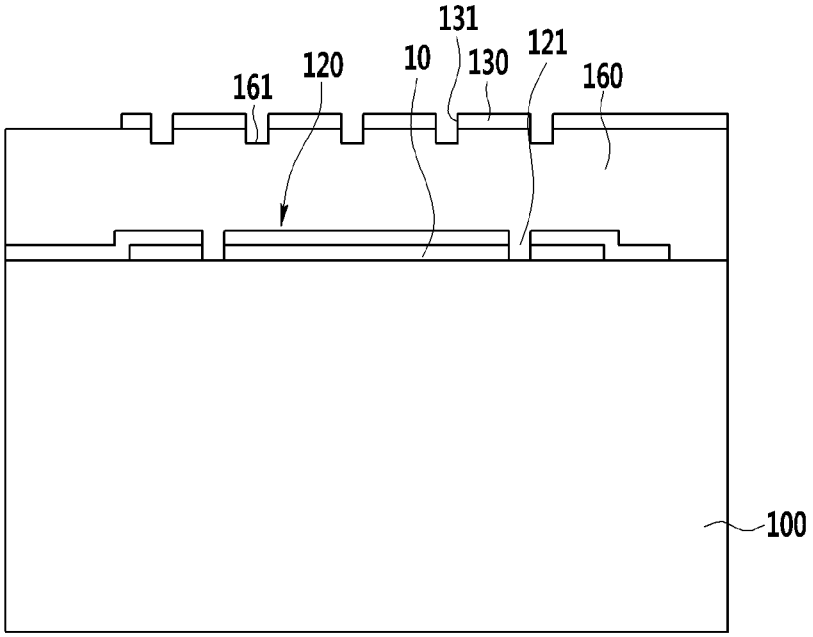

Referring to FIG. 6, a sacrificial layer 160 including a plurality of depression units 161 and the fixed electrode 130 including the plurality of openings 131 are formed on the vibration membrane 120. The sacrificial layer 160 may be made of photoresist materials, a silicon oxide, or a silicon nitride. The fixed electrode 130 may be made of polysilicon or a metal.

The sacrificial layer 160 and the fixed electrode 130 may be formed by forming a photoresist material layer, a silicon oxide layer, or a silicon nitride layer on the vibration membrane 120, forming a polysilicon layer or a metal layer on the photoresist material layer, the silicon oxide layer, or the silicon nitride layer, and simultaneously patterning the photoresist material layer, the silicon oxide layer, or the silicon nitride layer and the polysilicon layer or the metal layer. In this case, the plurality of depression units 161 are formed in the sacrificial layer 160, and the plurality of openings 131 are formed in the fixed electrode 130. In this case, the boundary lines of the respective depression units 161 are the same as those of the respective openings 131.

Figure 7:
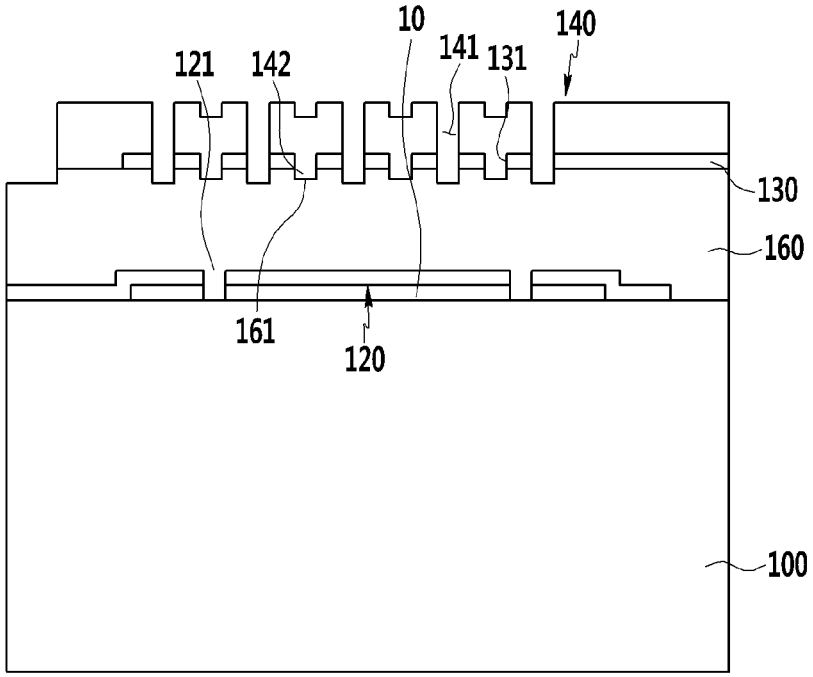

Referring to FIG. 7, the fixed plate 140 is formed over the fixed electrode 130 and the sacrificial layer 160. The plurality of air inlets 141 are formed by patterning the fixed plate 140 and the fixed electrode 130. The fixed plate 140 may be made of a silicon nitride.

Furthermore, the fixed plate 140 includes the plurality of first protrusions 142. The first protrusions 142 are configured to penetrate the respective openings 131 of the fixed electrode 130 and are formed in the respective depression units 161 of the sacrificial layer 160. Part of the sacrificial layer 160 is exposed through the fixed plate 140 and the air inlets 141.

Figure 8:
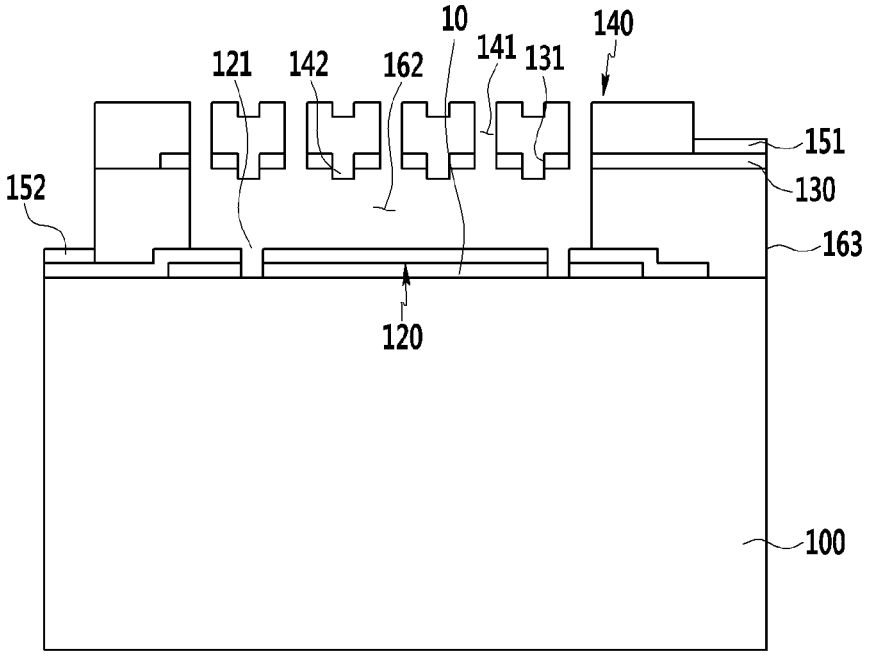

Referring to FIG. 8, after the first pad 151 connected to the fixed electrode 130 and the second pad 152 connected to the vibration membrane 120 are formed, the air layer 162 and the support layer 163 are formed by removing part of the sacrificial layer 160.

After the fixed electrode 130 is exposed by removing part of the fixed plate 140, the first pad 151 is formed on the exposed fixed electrode 130. After the vibration membrane 120 is exposed by removing part of the sacrificial layer 160, the second pad 152 is formed on the exposed vibration membrane 120.

The air layer 162 may be formed by removing part of the sacrificial layer 160 by a wet method using an etchant through the air inlets 141. Furthermore, the air layer 162 may be formed using a dry method such as ashing according to oxygen plasma, through the air inlets 141. Part of the sacrificial layer 160 is removed through a wet or dry method, and thus the air layer 162 is formed between the fixed electrode 130 and the vibration membrane 120. The sacrificial layer 160 that remains intact without being removed forms the support layer 163 that supports the fixed electrode 130. The support layer 163 is placed at the edge of the vibration membrane 120.

When the sacrificial layer 160 is removed, a stiction phenomenon in which the vibration membrane 120 and the fixed electrode 130 stick to each other may occur. The first protrusions 142 of the fixed plate 140 may prevent such a stiction phenomenon.

Referring to FIG. 1, the penetration hole 110 is formed in the substrate 100. The penetration hole 110 is formed by performing dry etching or wet etching on the rear of the substrate 100. When the rear of the substrate 100 is etched, the oxide layer 10 is etched so that part of the vibration membrane 120 is exposed. Accordingly, the slots 121 are formed over the penetration hole 110.

Another microphone in accordance with embodiments of the present disclosure is described below with reference to FIG. 9.

Figure 9:
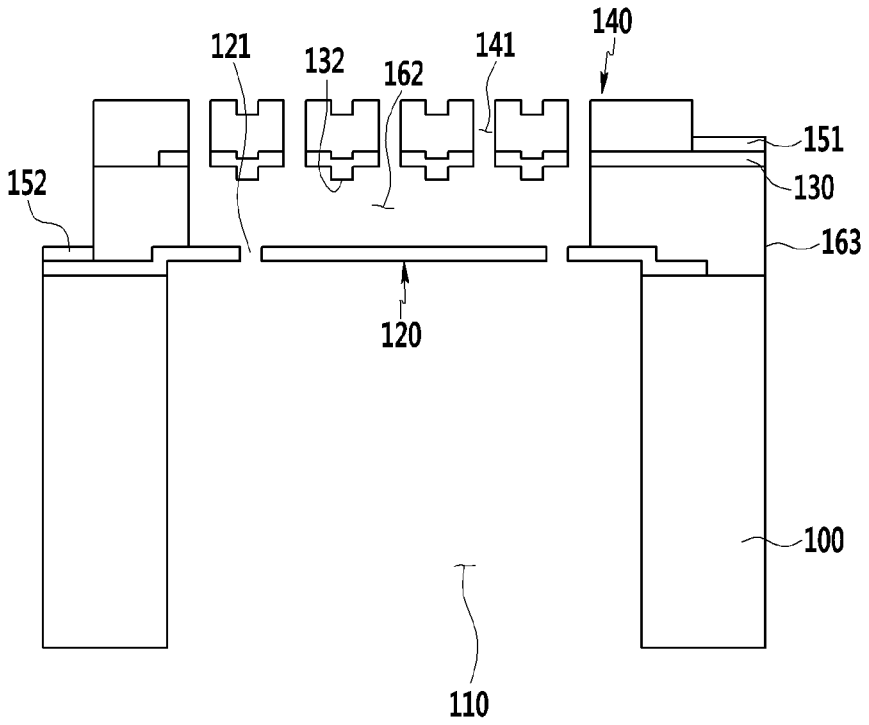
FIG. 9 is a schematic cross-sectional view of a microphone in accordance with embodiments of the present disclosure.

FIG. 9 is a schematic cross-sectional view of the microphone in accordance with embodiments of the present disclosure.

Referring to FIG. 9, the microphone has the same structure as that of FIG. 1 except for the shapes of the fixed electrode and the fixed plate. Accordingly, a description of the same elements as those of the microphone of FIG. 1 is omitted.

A fixed electrode 130 spaced apart from a vibration membrane 120 is disposed on the vibration membrane 120, and a fixed plate 140 is disposed on the fixed electrode 130. A plurality of air inlets 141 are disposed in the fixed electrode 130 and the fixed plate 140. The fixed electrode 130 is disposed on a support layer 163 and fixed thereto. The support layer 163 is disposed at an edge part of the vibration membrane 120 and is configured to support the fixed electrode 130. In this case, the fixed electrode 130 is made of polysilicon or metal. Furthermore, the fixed electrode 130 includes a plurality of second protrusions 132. The second protrusions 132 are protruded in the direction from the fixed electrode 130 to the vibration membrane 120.

An air layer 162 is formed between the fixed electrode 130 and the vibration membrane 120. The fixed electrode 130 is spaced apart from the vibration membrane 120 by a predetermined interval.

The fixed plate 140 comes in contact with the fixed electrode 130. The fixed plate 140 may be made of a silicon nitride. However, the materials of the fixed plate 140 are not limited to a silicon nitride. For example, the fixed plate 140 may be made of the same materials as the fixed electrode 130.

An external sound is introduced through the air inlets 141 formed in the fixed electrode 130 and the fixed plate 140, thus stimulating the vibration membrane 120. In response thereto, the vibration membrane 120 is vibrated.

When the vibration membrane 120 is vibrated in response to the external sound, the distance between the vibration membrane 120 and the fixed electrode 130 is changed. Accordingly, capacitance between the vibration membrane 120 and the fixed electrode 130 is changed. A signal processing circuit (not shown) converts the changed capacitance into an electrical signal through a first pad 151 connected to the fixed electrode 130 and a second pad 152 connected to the vibration membrane 120, thereby being capable of detecting the external sound.

Another method of manufacturing the microphone in accordance with embodiments of the present disclosure is described below with reference to FIGS. 10 to 13.

FIGS. 10 to 13 are diagrams illustrating a method of manufacturing the microphone in accordance with embodiments of the present disclosure.

Figure 10:
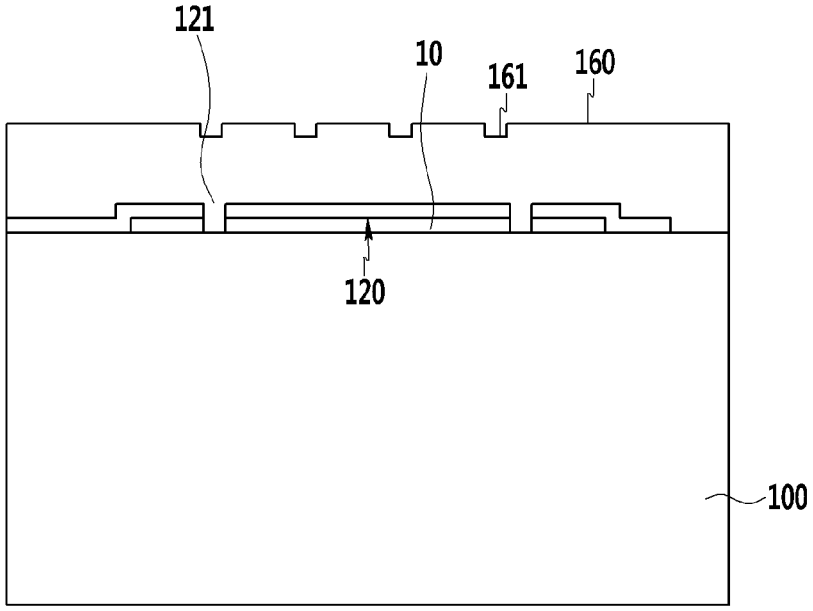
FIGS. 10 to 13 are diagrams illustrating a method of manufacturing the microphone in accordance with embodiments of the present disclosure.

Referring to FIG. 10, after the substrate 100 is prepared, an oxide layer 10 is formed on the substrate 100. The vibration membrane 120 including the plurality of slots 121 is formed on the oxide layer 10. In this case, the substrate 100 may be made of silicon, and the vibration membrane 120 may be made of polysilicon or conductive materials.

Thereafter, after a sacrificial layer 160 is formed on the vibration membrane 120 and the substrate 100, a plurality of depression units 161 is formed in the sacrificial layer 160. In this case, the sacrificial layer 160 may be made of photoresist materials, a silicon oxide, or a silicon nitride. The plurality of depression units 161 may be formed by etching part of the sacrificial layer 160.

Figure 11:
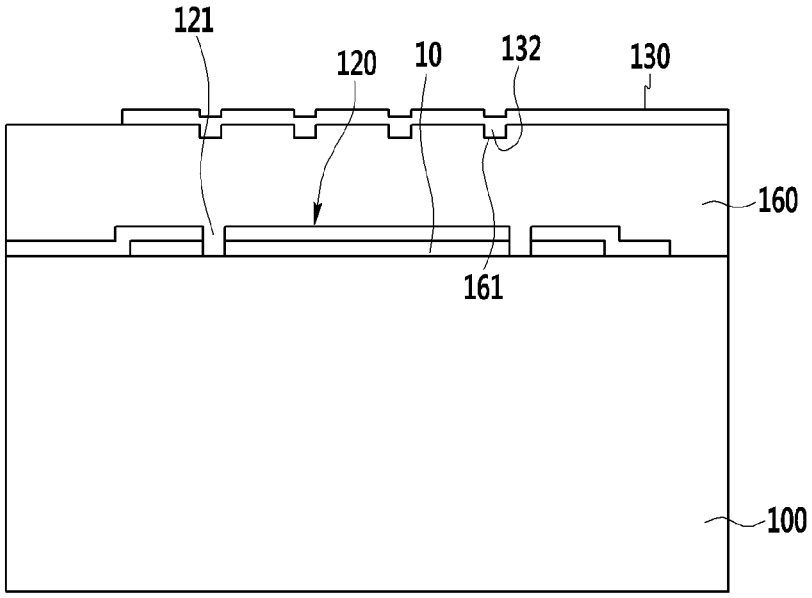

Referring to FIG. 11, the fixed electrode 130 including the plurality of second protrusions 132 is formed on the sacrificial layer 160. In this case, the fixed electrode 130 may be made of polysilicon or a metal. The second protrusions 132 are formed over the respective depression units 161. Furthermore, part of the sacrificial layer 160 is exposed through the fixed electrode 130.

Figure 12:
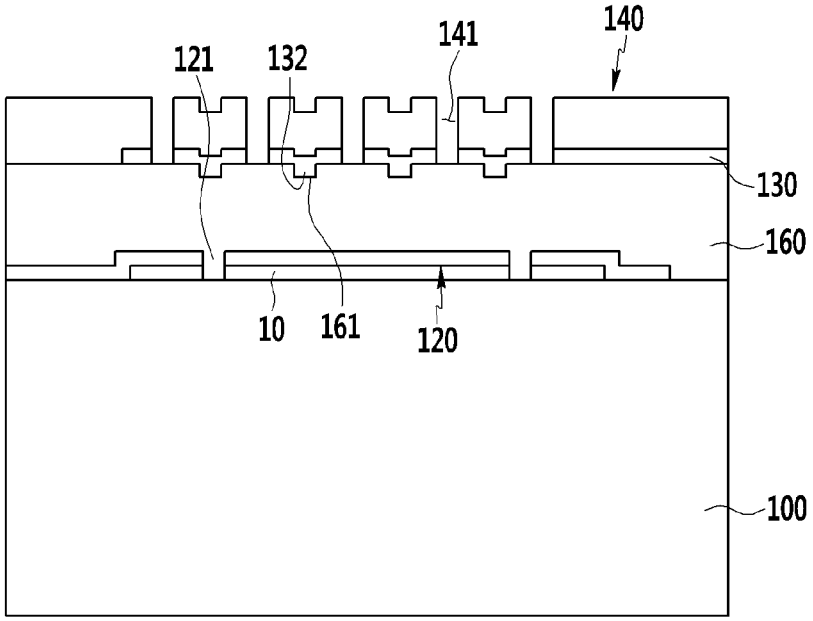

Referring to FIG. 12, after the fixed plate 140 is formed on the fixed electrode 130 and the sacrificial layer 160, the plurality of air inlets 141 are formed by patterning the fixed plate 140 and the fixed electrode 130. In this case, the fixed plate 140 may be made of a silicon nitride. Furthermore, part of the sacrificial layer 160 is exposed through the air inlets 141.

Figure 13:
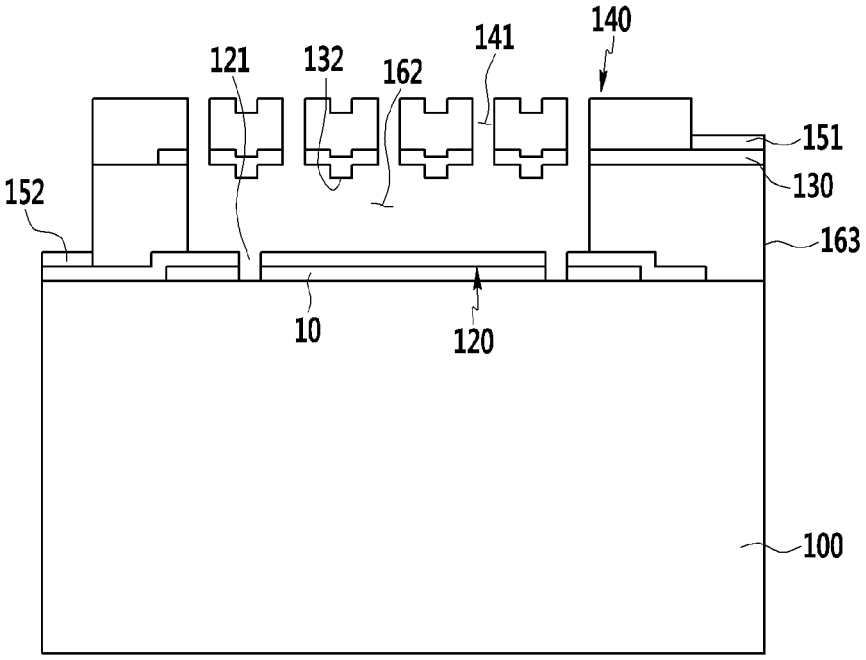

Referring to FIG. 13, after a first pad 151 connected to the fixed electrode 130 and a second pad 152 connected to the vibration membrane 120 are formed, the air layer 162 and the support layer 163 are formed by removing part of the sacrificial layer 160.

After the fixed electrode 130 is exposed by removing part of the fixed plate 140, the first pad 151 is formed on the exposed fixed electrode 130. After the vibration membrane 120 is exposed by removing part of the fixed plate 140 and the sacrificial layer 160, the second pad 152 is formed on the exposed vibration membrane 120.

The air layer 162 may be formed by removing part of the sacrificial layer 160 by a wet method using an etchant through the air inlets 141. Furthermore, the air layer 162 may be formed using a dry method such as ashing according to oxygen plasma, through the air inlets 141. Part of the sacrificial layer 160 is removed through a wet or dry method, and thus the air layer 162 is formed between the fixed electrode 130 and the vibration membrane 120. The sacrificial layer 160 that remains intact without being removed forms the support layer 163 that supports the fixed electrode 130. The support layer 163 is formed at the edge of the vibration membrane 120.

When the sacrificial layer 160 is removed, a stiction phenomenon in which the vibration membrane 120 and the fixed electrode 130 stick to each other may occur. The second protrusion 132 of the fixed electrode 130 may prevent such a stiction phenomenon.

Referring to FIG. 9, the penetration hole 110 is formed in the substrate 100.

The penetration hole 110 is formed by performing dry etching or wet etching on the rear of the substrate 100. When the rear of the substrate 100 is etched, the oxide layer 10 is etched so that part of the vibration membrane 120 is exposed. Accordingly, the slots 121 are formed over the penetration hole 110.

Another microphone in accordance with embodiments of the present disclosure is described below with reference to FIGS. 14 and 15.

Figure 14:
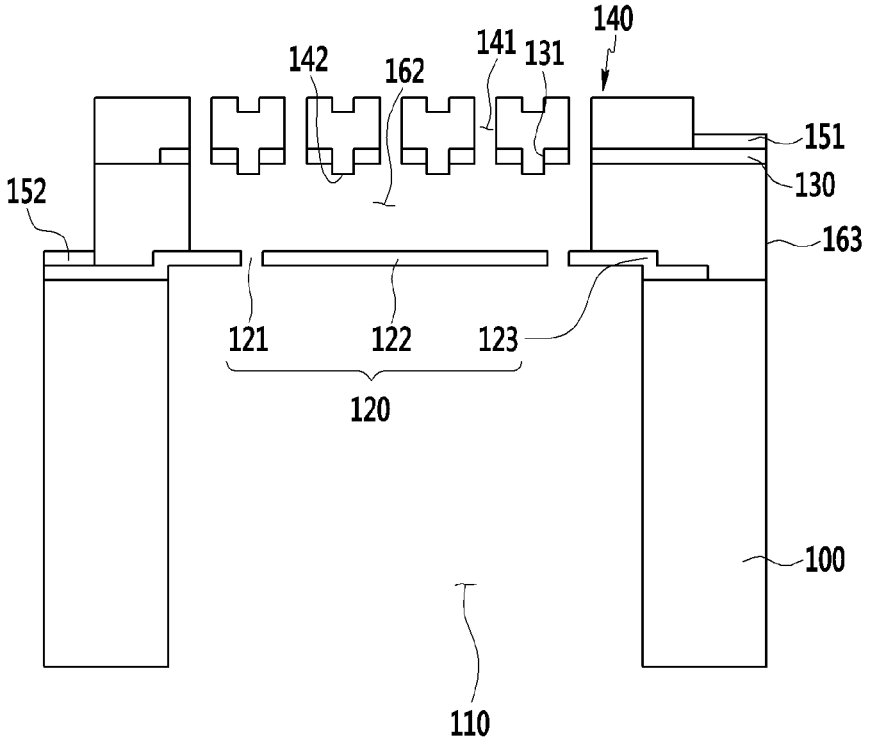
FIG. 14 is a schematic cross-sectional view of a microphone in accordance with embodiments of the present disclosure.
Figure 15:
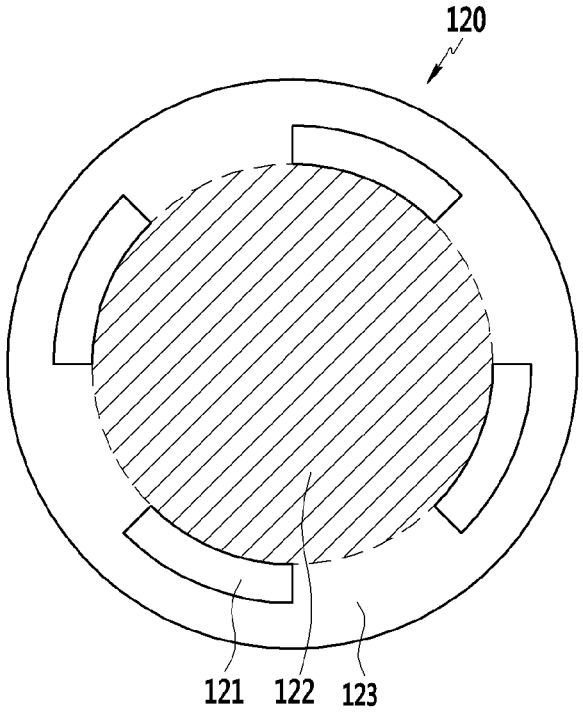
FIG. 15 is a top plan view schematically illustrating the vibration membrane of the microphone of FIG. 14.

FIG. 14 is a schematic cross-sectional view of a microphone in accordance with embodiments of the present disclosure, and FIG. 15 is a top plan view schematically illustrating the vibration membrane of the microphone of FIG. 14.

Referring to FIGS. 14 and 15, the microphone has the same structure as that of FIG. 1 except for the structure of the vibration membrane. Accordingly, a description of the same elements as those of the microphone of FIG. 1 is omitted.

The vibration membrane 120 may be made of polysilicon or conductive materials, and it includes a plurality of slots 121, a first part 122, and a second part 123. The slots 121 are formed over a penetration hole 110 and placed outside the first part 122. The vibration membrane 120 has been illustrated as having four slots 121, but the number of slots 121 is not limited to 4 and may be greater than 4. The slots 121 may have the same size or different sizes. The entire area of the slots 121 may be 8% to 19% of the entire area of the vibration membrane 120.

The first part 122 is placed on the penetration hole 110, and ions are injected into the first part 122. The ions may include boron ions or phosphorous ions. The second part 123 is formed in the circumference of the first part 122, and it functions as a spring for vibrating the vibration membrane 120. The first part 122 has greater stiffness than the second part 123 because the ions are injected into the first part 122.

When the vibration membrane 120 is vibrated in response to an external sound through the air inlets 141, the distance between the vibration membrane 120 and the fixed electrode 130 is changed. In particular, the distance between the first part 122 of the vibration membrane 120 and the fixed electrode 130 is changed. However, the first part 122 is not bent because the first part 122 has increased stiffness by injecting the ions into the first part 122. Accordingly, a detection area is improved. When the vibration membrane 120 is vibrated in response to an external sound, the slots 121 reduces an influence attributable to air damping, thereby improving the sensitivity of the microphone.

Another method of manufacturing the microphone in accordance with embodiments of the present disclosure is described with reference to FIG. 16.

Figure 16:
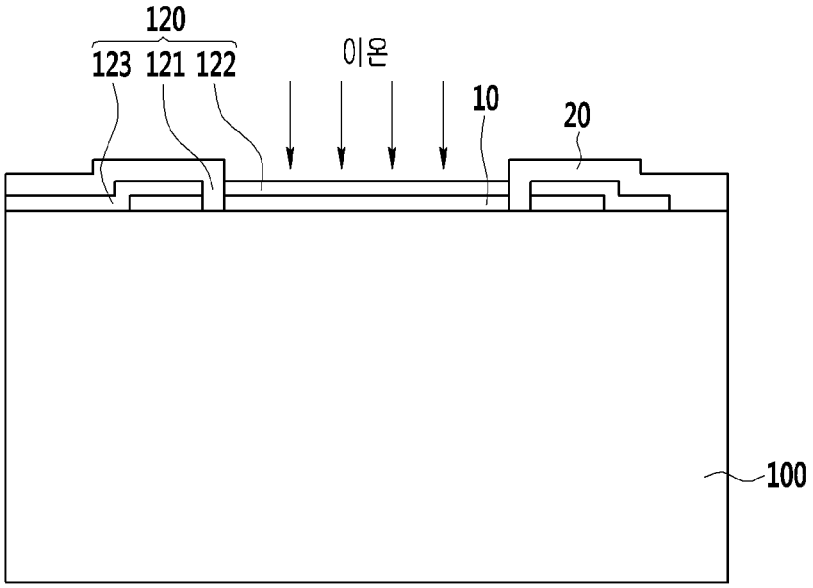
FIG. 16 is a diagram illustrating a method of manufacturing the microphone in accordance with embodiments of the present disclosure.

FIG. 16 is a diagram illustrating a method of manufacturing the microphone in accordance with embodiments of the present disclosure. The method of manufacturing the microphone is the same as that of the manufacturing the microphone of FIG. 1 except that a process of injecting ions into the vibration membrane is added. A description of the same processes as those of the method of manufacturing the microphone of FIG. 1 is omitted.

Referring to FIG. 16, after the substrate 100 is prepared, an oxide layer 10 is formed on the substrate 100. After the vibration membrane 120 including the plurality of slots 121 is formed on the oxide layer 10, a buffer layer 20 is formed on the vibration membrane 120 and the substrate 100. In this case, the substrate 100 may be made of silicon. The vibration membrane 120 may be made of polysilicon or conductive materials. A central part of the vibration membrane 120 is exposed through the buffer layer 20.

Thereafter, ions are injected into the exposed vibration membrane 120 using the buffer layer 20 as a mask. Accordingly, the vibration membrane 120 includes the slots 121, the first part 122, and the second part 123. The first part 122 corresponds to a part into which the ions have been injected. The second part 123 is formed in the circumference of the first part 122, and it functions as a spring for vibrating the vibration membrane 120. The ions may include boron ions or phosphorous ions. The first part 122 has greater stiffness than the second part 123 because the ions are injected into the first part 122. Subsequent processes are the same as those illustrated in FIGS. 6 to 9 after the buffer layer 20 is removed.

Another microphone in accordance with embodiments of the present disclosure is described below with reference to FIG. 17.

Figure 17:
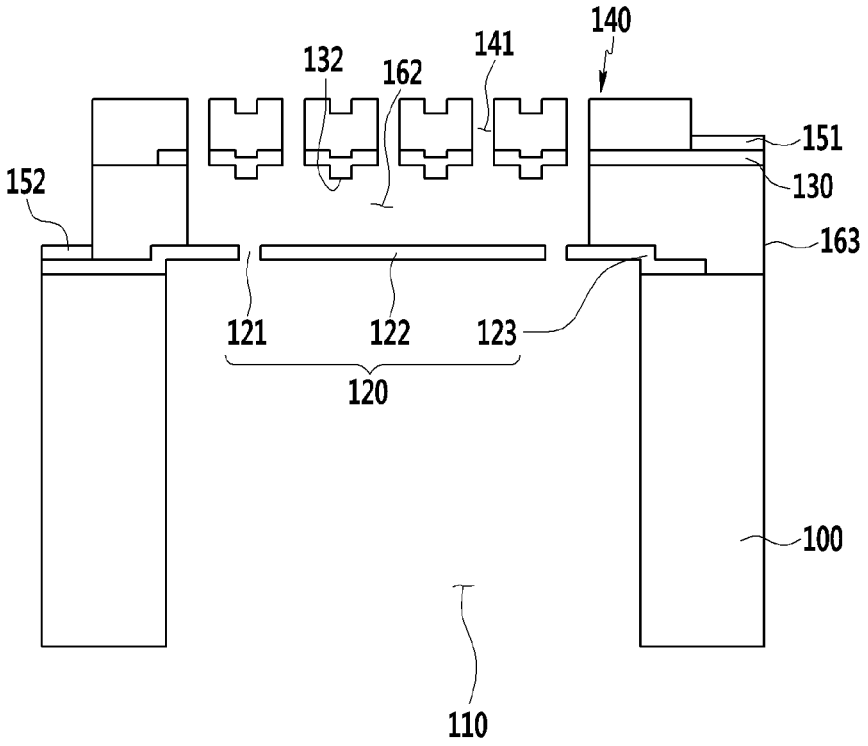
FIG. 17 is a schematic cross-sectional view of a microphone in accordance with embodiments of the present disclosure.

FIG. 17 is a schematic cross-sectional view of a microphone in accordance with embodiments of the present disclosure.

Referring to FIG. 17, the microphone has the same structure as that of FIG. 9 except for the structure of the vibration membrane. Accordingly, a description of the same elements as those of FIG. 9 is omitted.

A vibration membrane 120 may be made of polysilicon or conductive materials. The vibration membrane 120 includes a plurality of slots 121, a first part 122, and a second part 123. The slots 121 are formed on a penetration hole 110 and outside the first part 122. The vibration membrane 120 has been illustrated as having four slots 121, but the number of slots 121 is not limited thereto. For example, the number of slots 121 may be greater than 4. The slots 121 may have the same size or different sizes. The entire area of the slots 121 may be approximately 8% to approximately 19% of the entire area of the vibration membrane 120.

The first part 122 is formed on the penetration hole 110. Ions are injected into the first part 122. In this case, the ions may include boron ions or phosphorous ions. The second part 123 is placed in the circumference of the first part 122, and it functions as a spring for vibrating the vibration membrane 120. The first part 122 has greater stiffness than the second part 123 because the ions are injected into the first part 122.

When the vibration membrane 120 is vibrated in response to an external sound introduced through air inlets 141, the distance between the vibration membrane 120 and a fixed electrode 130 is changed. Particularly, the distance between the first part 122 of the vibration membrane 120 and the fixed electrode 130 is changed. However, the first part 122 is not bent because the first part 122 has increased stiffness by injecting the ions into the first part 122. Accordingly, a detection area is improved. When the vibration membrane 120 is vibrated in response to an external sound, the slots 121 reduces an influence attributable to air damping, thereby improving sensitivity of the microphone.

While this disclosure has been described in connection with what is presently considered to be embodiments, it is to be understood that the disclosure is not limited to the disclosed embodiments, but, on the contrary, is intended to cover various modifications and equivalent arrangements included within the spirit and scope of the appended claims.

<Description of symbols>

| | |
|---|---|
| 110: substrate | 110: penetration hole |
| 120: vibration membrane | 121: slot |
| 122: first part | 123: second part |
| 130: fixed electrode | 131: opening |
| 132: second protrusion | 140: fixed plate |
| 141: air inlet | 142: first protrusion |
| 160: sacrificial layer | 161: depression unit |
| 162: air layer | 163: support layer |

What is claimed is:

1. A microphone, comprising:

a substrate including a penetration hole;

a vibration membrane disposed over the substrate and covering the penetration hole;

a fixed electrode disposed over the vibration membrane and spaced apart from the vibration membrane;

a fixed plate disposed over the fixed electrode; and a plurality of air inlets disposed in the fixed electrode and the fixed plate, wherein the vibration membrane includes a plurality of slots positioned over the penetration hole, and an entire area of the plurality of slots is approximately 8% to approximately 19% of an entire area of the vibration membrane, wherein the vibration membrane includes a first part into which ions are injected and a second part positioned at a circumference of the first part, and wherein the plurality of slots are positioned outside of the first part.

2. The microphone of claim 1, wherein the ions include boron ions or phosphorous ions.

3. The microphone of claim 2, wherein the fixed electrode includes a plurality of openings.

4. The microphone of claim 3, wherein:

the fixed plate includes a plurality of first protrusions protruding in a direction from the fixed plate toward the vibration membrane, and the plurality of first protrusions penetrate the respective openings.

5. The microphone of claim 2, wherein the fixed electrode includes a plurality of second protrusions protruding in a direction from the fixed electrode toward the vibration membrane.

6. The microphone of claim 1, wherein the vibration membrane is made of polysilicon or conductive materials.

7. The microphone of claim 6, wherein the fixed electrode is made of polysilicon or a metal.

8. The microphone of claim 7, wherein the fixed plate includes a silicon nitride film.

9. The microphone of claim 8, wherein the substrate is made of silicon.

10. The microphone of claim 1, further comprising a support layer disposed at an edge of the vibration membrane and configured to support the fixed electrode.

11. A method of manufacturing a microphone, comprising:

providing a substrate;

forming a vibration membrane including a plurality of slots over the substrate;

forming a sacrificial layer over the vibration membrane, wherein the vibration membrane includes a first part into which ions are injected and a second part positioned at a circumference of the first part;

forming a fixed electrode over the sacrificial layer;

forming a fixed plate over the fixed electrode;

forming a plurality of air inlets in the fixed electrode and the fixed plate;

forming an air layer between the fixed electrode and the vibration membrane by removing part of the sacrificial layer; and forming a penetration hole in the substrate, through which a part of the vibration membrane is exposed, by etching a rear of the substrate, wherein the plurality of slots are positioned outside of the first part, and an entire area of the plurality of slots is approximately 8% to approximately 19% of an entire area of the vibration membrane.

12. The method of claim 11, wherein the plurality of slots are positioned over the penetration hole.

13. The method of claim 12, wherein the forming of the vibration membrane comprises:

forming a buffer layer, through which a central part of the vibration membrane is exposed, over the vibration membrane;

injecting the ions into the exposed part of the vibration membrane using the buffer layer as a mask to form the first part; and removing the buffer layer.

14. The method of claim 13, wherein the ions include boron ions or phosphorous ions.

15. The method of claim 14, wherein the forming of the fixed electrode comprises forming a plurality of openings and a plurality of depression units of the sacrificial layer in the fixed electrode, wherein boundary lines of the respective openings are substantially identical to boundary lines of the respective depression units.

16. The method of claim 15, wherein:

the fixed plate includes a plurality of first protrusions configured to penetrate the respective openings and formed in the respective depression units.

17. The method of claim 14, wherein the forming of the sacrificial layer comprises forming a plurality of depression units by etching part of the sacrificial layer.

18. The method of claim 17, wherein the fixed electrode includes a plurality of second protrusions which are positioned in the respective depression units.

* * * * *